US006199323B1

(12) United States Patent
Autovino

(10) Patent No.: US 6,199,323 B1
(45) Date of Patent: Mar. 13, 2001

(54) DOUBLE-HUNG WINDOW STRUCTURE AND SEALS

(76) Inventor: Enrico Autovino, 10 S. Inman Ave., Avenel, NJ (US) 07001

( * ) Notice: Subject to any disclaimer, the term of this patent is extended or adjusted under 35 U.S.C. 154(b) by 0 days.

(21) Appl. No.: 09/431,037

(22) Filed: Oct. 31, 1999

(51) Int. Cl.[7] ..... E05D 15/16; E05B 7/16

(52) U.S. Cl. ..... 49/428; 49/472

(58) Field of Search ..... 49/428, 161, 489.1, 49/406, 458, 483.1, 472–474, 469, 404, 501; 52/204.57, 204.58

(56) References Cited

U.S. PATENT DOCUMENTS

| | | | | |
|---|---|---|---|---|
| 1,979,951 | * | 11/1934 | Lyon | 52/204.57 X |
| 2,259,008 | * | 10/1941 | Swanson | 49/406 X |
| 2,599,183 | * | 6/1952 | Kessler | 49/489.1 X |
| 2,895,182 | * | 7/1959 | Evans | 49/458 X |
| 3,432,966 | * | 3/1969 | Bordner | 49/458 X |
| 4,395,847 | * | 8/1983 | Atchison | 49/406 |
| 4,464,864 | | 8/1984 | Yackiw . | |
| 4,558,536 | * | 12/1985 | Dunsmoor | 49/501 X |
| 4,704,821 | | 11/1987 | Berndt . | |
| 4,726,147 | * | 2/1988 | Beske et al. | 49/406 |
| 4,916,863 | | 4/1990 | Burrous et al. . | |
| 5,111,616 | * | 5/1992 | Calabrese | 49/406 |
| 5,363,596 | * | 11/1994 | Kronbetter | 49/489.1 X |
| 5,411,785 | * | 5/1995 | Cook | 49/490.1 X |
| 5,560,154 | | 10/1996 | Matarazzo . | |
| 5,649,389 | | 7/1997 | Coddens . | |

* cited by examiner

*Primary Examiner*—Daniel P. Stodola
*Assistant Examiner*—Hugh B. Thompson
(74) *Attorney, Agent, or Firm*—Ezra Sutton

(57) ABSTRACT

A double-hung window structure including an upper window and a lower window within a window frame having seals. The upper and lower windows include a plurality of interlocking horizontal and vertical mutton members for forming a plurality of window openings with each having a window pane therein. The double-hung window structure includes a first sealing assembly located between the right stile of the upper window and the right jamb of the window frame; a second sealing assembly located between the left stile of the upper window and the left jamb of the window frame; a third sealing assembly located between the right stile of the lower window and the right jamb of the window frame; and a fourth sealing assembly located between the left stile of the lower window and the left jamb of the window frame. Additionally, the double-hung window structure includes a fifth sealing assembly located between the top rail of the upper window and the upper window track of the upper header of the window frame; a sixth sealing assembly located between the meeting rail of the upper window and the meeting rail of the lower window; and a seventh sealing assembly located between the bottom rail of the lower window and the lower window track of the sill of the window frame. The mutton members are formed of wood having a density of at least 44 pounds per cubic foot.

11 Claims, 11 Drawing Sheets

DOUBLE-HUNG WINDOW STRUCTURE AND SEALS

FIELD OF THE INVENTION

This invention relates to a double-hung window structure with an improved weatherstripping arrangement against water leakage, and improved structural and strength characteristics in resisting the flexing against high winds. More particularly, this double-hung window structure is for use in schools, wherein the window structure has met all SCA standards and specifications for water leakage, wind resistance and structural strength.

BACKGROUND OF THE INVENTION

Restoration and new construction on school buildings entails replacing or adding of new window structures to the school. The restoration aspect includes window replacements that are similar such that an aesthetic appearance and character of the school building is maintained. New school building construction includes new windows that also meet the aesthetic appearance that was required by the architectural design selected by the school authorities, as well as the safety standards required for the selected windows in meeting specifications with regard to water leakage, wind resistance and structural flex, etc. Many reproductions and new window structures do not meet all of the SCA standards and specifications for the safety requirements with regard to water, wind and structural strength required by various schoolboards, school engineers and the like.

There remains a need for a double-hung window structure for school and other buildings that includes improved weatherstripping arrangements for preventing water leakage through the window closure, as well as providing improved strength/structural characteristics in order to resist and/or flex during high winds, storms and the like. It is also desirable to improve and maximize the weather and draft resistance protection and energy efficiency of these window closures for improved window durability and improved school building performance and economy. Additionally, these improved double-hung window structures must meet all safety standards and specifications for school buildings set by the SCA in regard to water leakage, wind resistance, structural flex and/or other safety requirements needed.

None of the present-day double-hung window structures meet the standards and safety requirements of the present invention of a double-hung window structure having an improved weatherstripping arrangement and an improved structural arrangement for meeting these aforementioned safety requirements.

Accordingly, it is an object of the present invention to provide an improved double-hung window structure for school buildings that meets all the safety standards and specifications set by the SCA (for school buildings) with regard to water leakage, wind resistance, structural flex and the like.

Another object of the present invention is to provide a double-hung window structure that includes improved weatherstripping arrangements for preventing water leakage through the window during inclement weather, such as snow, rain, hail, ice and/or wind.

Another object of the present invention is to provide a double-hung window structure that includes improved strength and structural characteristics in order to resist and/or flex during inclement weather during which high winds occur, such as in northeastern storms, hurricanes, tornadoes, typhoons, tropical storms, and the like.

Another object of the present invention is to provide a double-hung window structure that improves and maximizes the weather protection and energy efficiency of these window closures for providing improved window durability, and improved school building performances (with regard to heat, electricity, air conditioning) and economy.

A further object of the present invention is to provide a double-hung window structure that can be mass produced in an automated and economical manner and is readily affordable by the user.

SUMMARY OF THE INVENTION

In accordance with the present invention, there is provided a double-hung window structure including an upper window and a lower window within a window frame having seals. The upper and lower windows include a plurality of interlocking horizontal and vertical mutton members for forming a plurality of window openings with each having a window pane therein. The double-hung window structure includes a first sealing assembly located between the right stile of the upper window and the right jamb of the window frame; a second sealing assembly located between the left stile of the upper window and the left jamb of the window frame; a third sealing assembly located between the right stile of the lower window and the right jamb of the window frame; and a fourth sealing assembly located between the left stile of the lower window and the left jamb of the window frame. Additionally, the double-hung window structure includes a fifth sealing assembly located between the top rail of the upper window and the upper window track of the upper header of the window frame; a sixth sealing assembly located between the meeting rail of the upper window and the meeting rail of the lower window; and a seventh sealing assembly located between the bottom rail of the lower window and the lower window track of the sill of the window frame. The mutton members are formed of wood having a density of at least 44 pounds per cubic foot.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
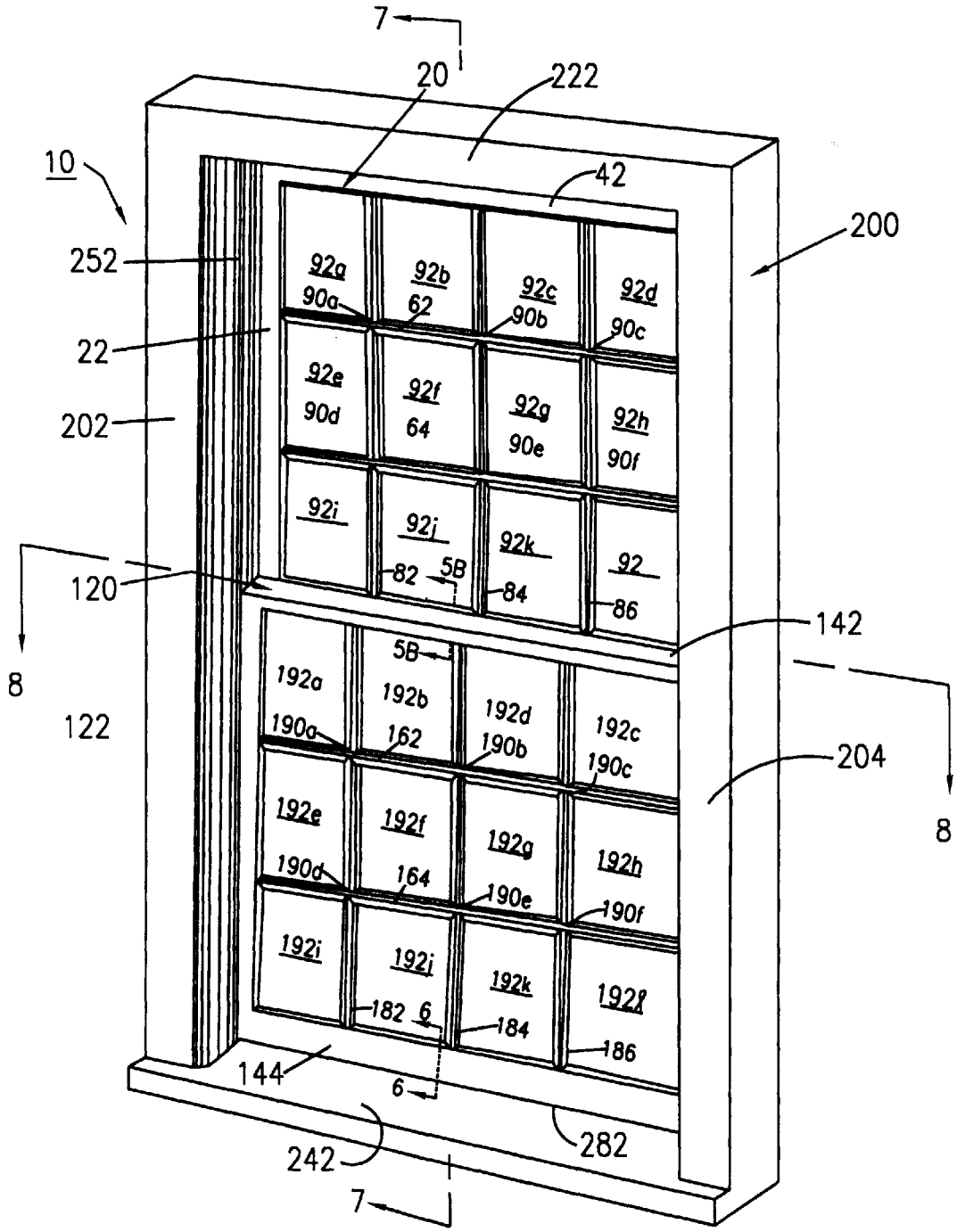
FIG. 1 is a perspective view of the double-hung window structure of the preferred embodiment of the present invention showing the upper and lower window members within the window frame in an assembled configuration.

The double-hung window structure 10 having weatherstripping seals of the preferred embodiment of the present invention are represented in detail by FIGS. 1 through 8 of the patent drawings. The double-hung window structure 10 was designed to meet SCA specifications and standards for new and restorated window structures being installed in schools. The double-hung window structure 10 includes an upper window 20, a lower window 120 and a window frame 200. The upper and lower windows 20 and 120 are arranged within the window frame 200, as shown in FIGS. 1 to 4 of the patent drawings.

Upper window 20 includes left and right stiles 22 and 24, a top rail 42, a meeting rail 44, a pair of mutton horizontal members 62 and 64, a plurality of mutton vertical members 82, 84 and 86 and a plurality of window panes 92*a* to 92*l* within window openings 94*a* to 94*l*.

Lower window 120 includes left and right stiles 122 and 124, a meeting rail 142, a bottom rail 144, a pair of mutton horizontal members 162 and 164, a plurality of mutton vertical members 182, 184 and 186, and a plurality of window panes 192*a* to 192*l* within window openings 194*a* to 194*l*.

Window frame 200 includes left and right frame jambs 202 and 204, an upper header 222, and a sill 242. Jambs 202 and 204 include upper and lower vertical window tracks 252, 254, 262 and 264, respectively. Upper header 222 includes an upper window track 272 for upper window 20; sill 242 includes a lower window track 282 for lower window 120, respectively.

Figure 3A:
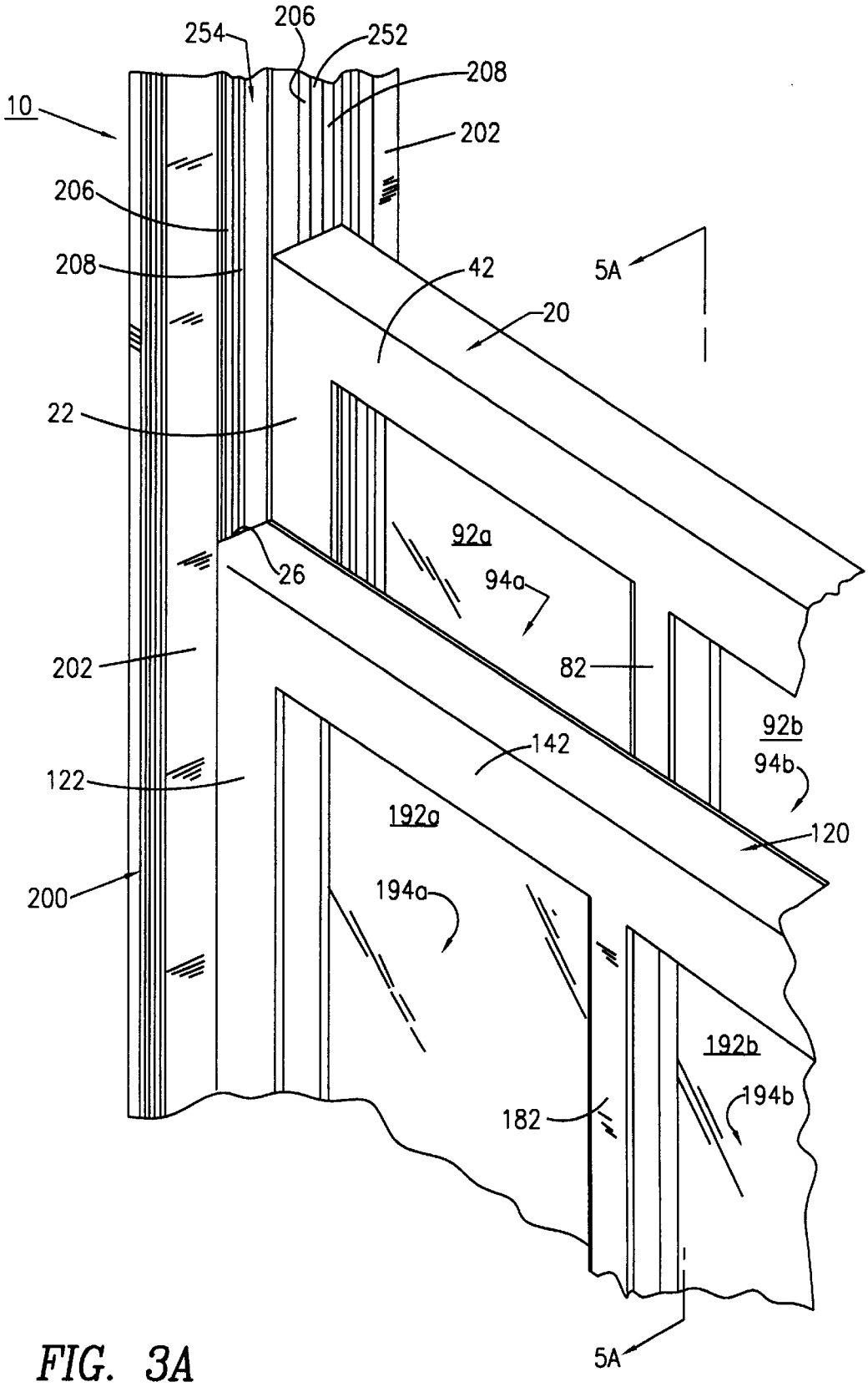
FIG. 3A is a perspective view of the double-hung window structure of the present invention showing the left jamb side of the window frame having a pair of window tracks therein for receiving of the upper and lower window members, respectively.
Figure 3B:
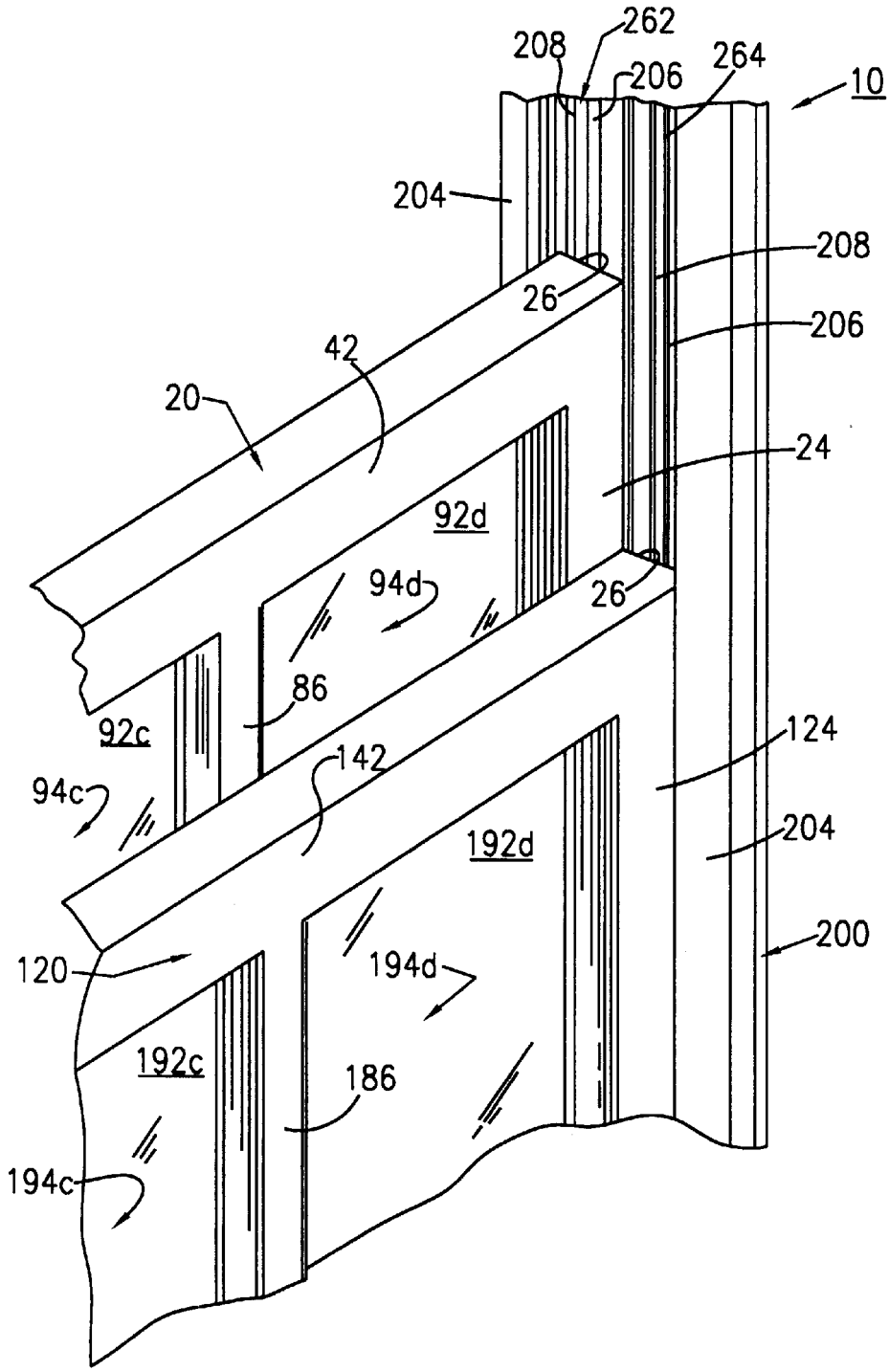
FIG. 3B is a perspective view of the double-hung window structure of the present invention showing the right jamb side of the window frame having a pair of window tracks therein for receiving of the upper and lower window members, respectively.
Figure 3C:
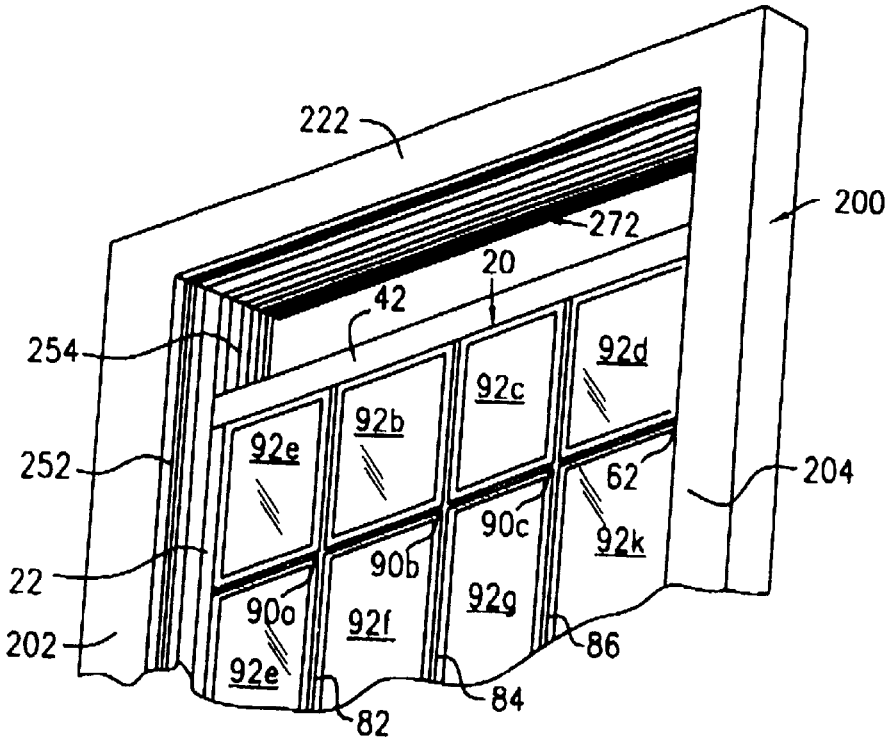
FIG. 3C is a perspective view of the double-hung window structure of the present invention showing the upper header of the window frame having a window track therein for receiving of the upper window member.
Figure 3D:
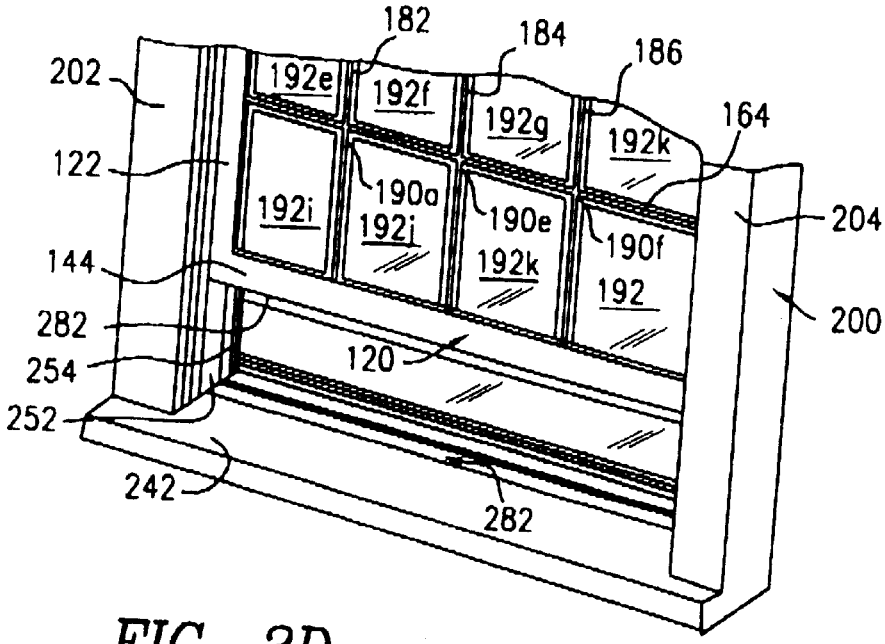
FIG. 3D is a perspective view of the double-hung window structure of the present invention showing the sill of the window frame having a window track therein for receiving of the lower window member.
Figure 8:
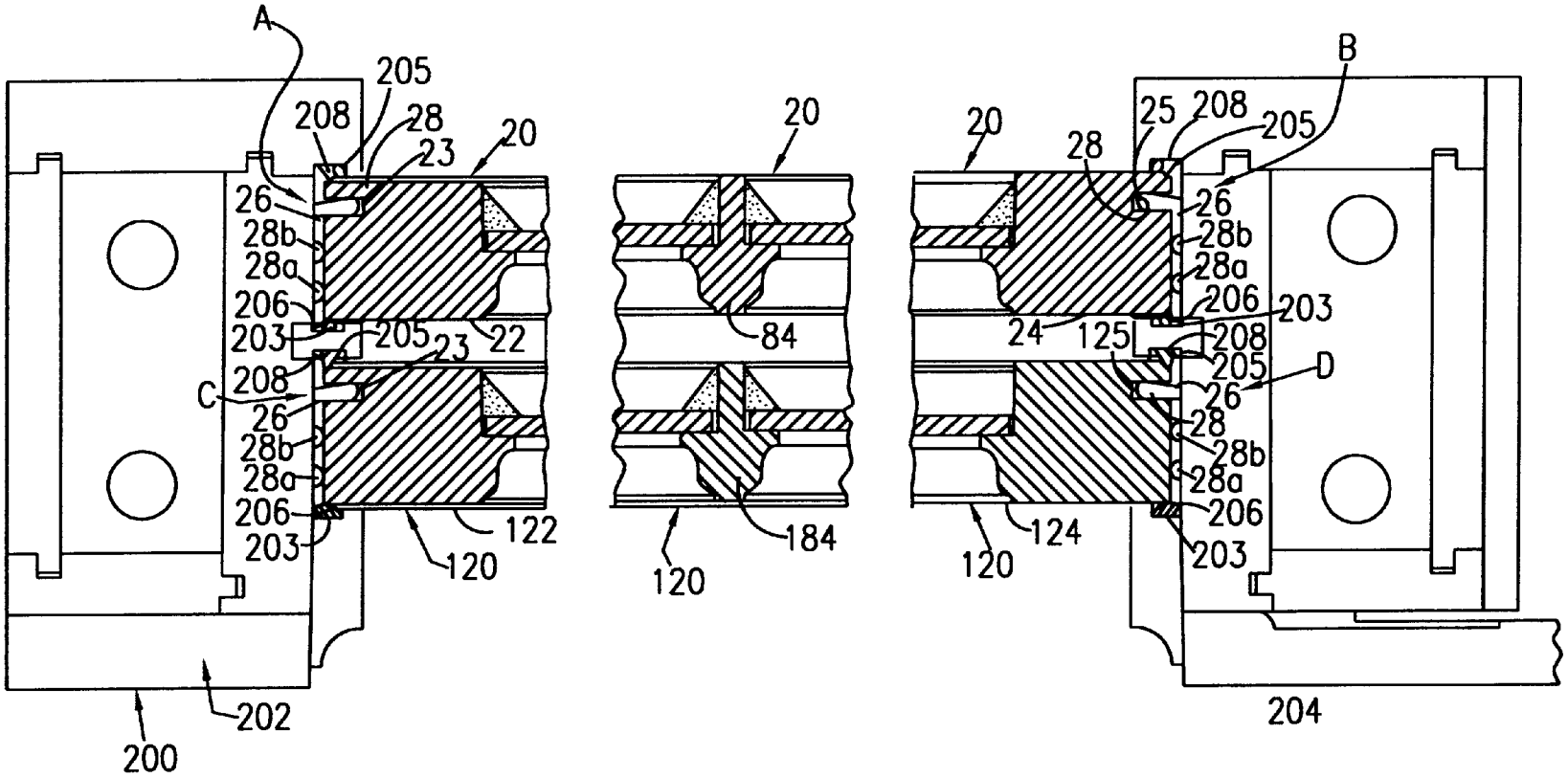
FIG. 8 is a horizontal cross-sectional view of the double-hung window structure of the present invention taken along lines 8—8 of FIG. 1 showing the weatherstripping arrangement within the upper and lower window members and frame member, respectively.

The right and left stiles 22 and 24 of upper window 20 in conjunction with the right and left jambs 202 and 204 of window frame 200 include a plurality of rigid and flexible weatherstripping seals. The seals on the right stile and right jamb include a rigid metal weatherstripping seal 26 being located on the right stile 22; and a pair of flexible channel weatherstripping seals 206 and 208 being located on the right jamb 202 of window frame 200, as shown in FIGS. 3A, 3B, and 8 of the drawings.

The weatherstripping seals for the left stile 24 of upper window 20 and the left jamb 204 of window frame 200, as well as the right and left stiles 122 and 124 of lower window 120 and the right and left jambs 202 and 204 of window frame 200, respectively, are exactly the same as the rigid and flexible weatherstripping seals 26, 206, and 208 previously described, as depicted in FIGS. 1, 2, 3A, 3B, and 8 of the drawings.

The first, second, third, and fourth sealing assemblies A, B, C and D are arranged in such a manner that each of the rigid metal weatherstripping seals 26 has an extending tongue member 28. The tongue member 28 is received within the stile receiving groove 23, 25, 123 and 125 of the upper and lower window stiles 22, 24, 122 and 124, respectively. The rigid metal weatherstripping seals 26 are held in place on stiles 22, 24, 122 and 124 by a plurality of brads (not shown). Additionally, each of the rigid metal weatherstripping seals 26 include a pair of concave indentations 28*a* and 28*b* which facilitates the vertical sliding (up and down) of the upper and lower windows 20 and 120 along the right and left jambs 202 and 204, respectively, of window frame 200. Additionally, each of the right and left jambs 202 and 204 of window frame 200 include a pair of flexible Q-lon™ channel weatherstripping seals 206 and 208 located on jamb edges 203 and 205 of jambs 202 and 204, respectively, at 90° degree angles relative to each of the rigid metal weatherstripping seals 26, as depicted in FIG. 8. Each of the seals 206 and 208 are held in place by a plurality of staples (not shown) that are positioned and stapled along the jamb edges 203 and 205, respectively.

The top rail 42 of upper window 20 in conjunction with the upper window track 272 of upper header 222 of window frame member 200 include a plurality of rigid and flexible weatherstripping seals. These seals include a rigid metal weatherstripping seal 46 and a pair of flexible Q-lon™ weatherstripping seals 48 and 50 being located in the top rail 42 of upper window 20; and a pair of transom flexible Q-lon™ channel weatherstripping seals 224 and 226 being located on the upper header 222 of window frame 200.

Figure 6A:
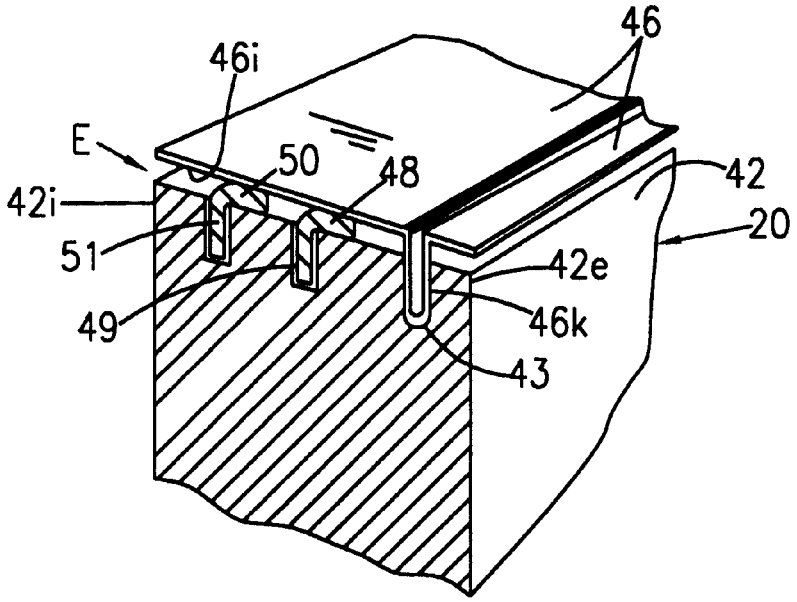
FIG. 6 is a horizontal cross-sectional view of the double-hung window structure of the present invention taken along lines 6—6 of FIG. 1 showing the weatherstripping arrangement within the upper and lower window members and frame member, respectively.
Figure 7:
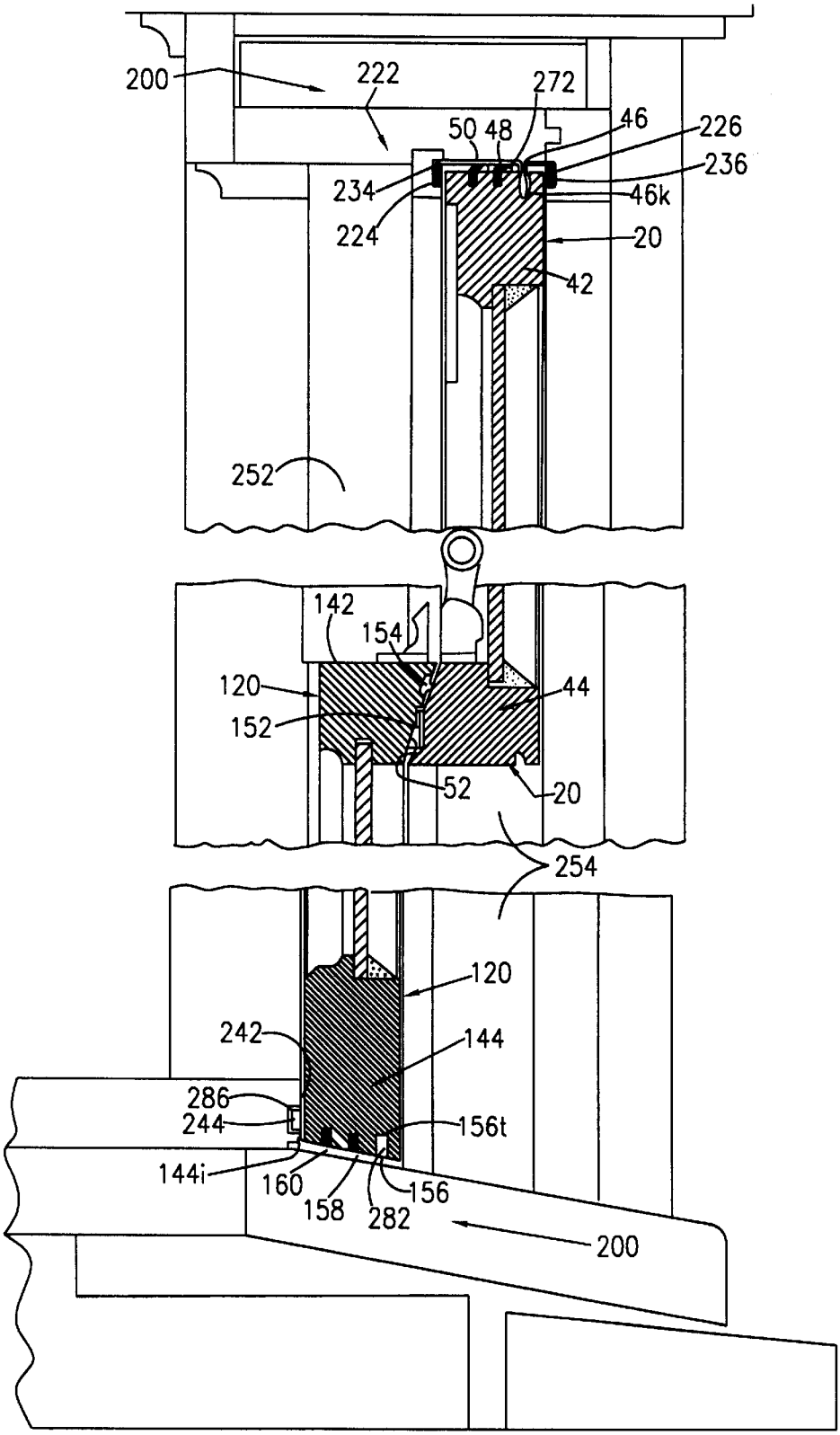
FIG. 7 is a side cross-sectional view of this double-hung window structure of the present invention taken along lines 7—7 of FIG. 1 showing the weatherstripping arrangement within the upper and lower window members and frame member, respectively.

The fifth sealing assembly E is arranged in such a manner that the rigid metal weatherstripping seal 46 has an extending tongue member 46*t* which is received within a first transom receiving groove 43 of the top rail 42 of upper window 20. This rigid metal weatherstripping seal 46 is held in place by a plurality of brads (not shown) on the edge of the top rail 42. The pair of inverted L-shaped flexible Q-lon™ weatherstripping seals 48 and 50 are received within second and third transom grooves 49 and 51 of the top rail 42 of upper window 20, respectively, as depicted in FIG. 6A of the drawings. Seals 48 and 50 are adjacent to and in contact with the interior wall surface 46*i* of the rigid metal weatherstripping seal 46. Seals 48 and 50 are held in place within grooves 49 and 51, respectively, with silicon adhesives (not shown). Additionally, the upper header 222 includes a pair of grooved channels 234 and 236 for receiving therein each of the frame transom flexible Q-lon™ channel weatherstripping seals 224 and 226, respectively. Seals 224 and 226 are positioned on the upper header 222, as shown in FIG. 7 of the drawings, such that the exterior and interior wall surfaces 42*e* and 42*i* of the upper transom abut and are adjacent to each of the seals 224 and 226, respectively. Seals 224 and 226 are held in place by a plurality of staples (not shown) that are stapled to the seals 224 and 226 within the grooved channels 234 and 236, respectively.

Figure 5A:
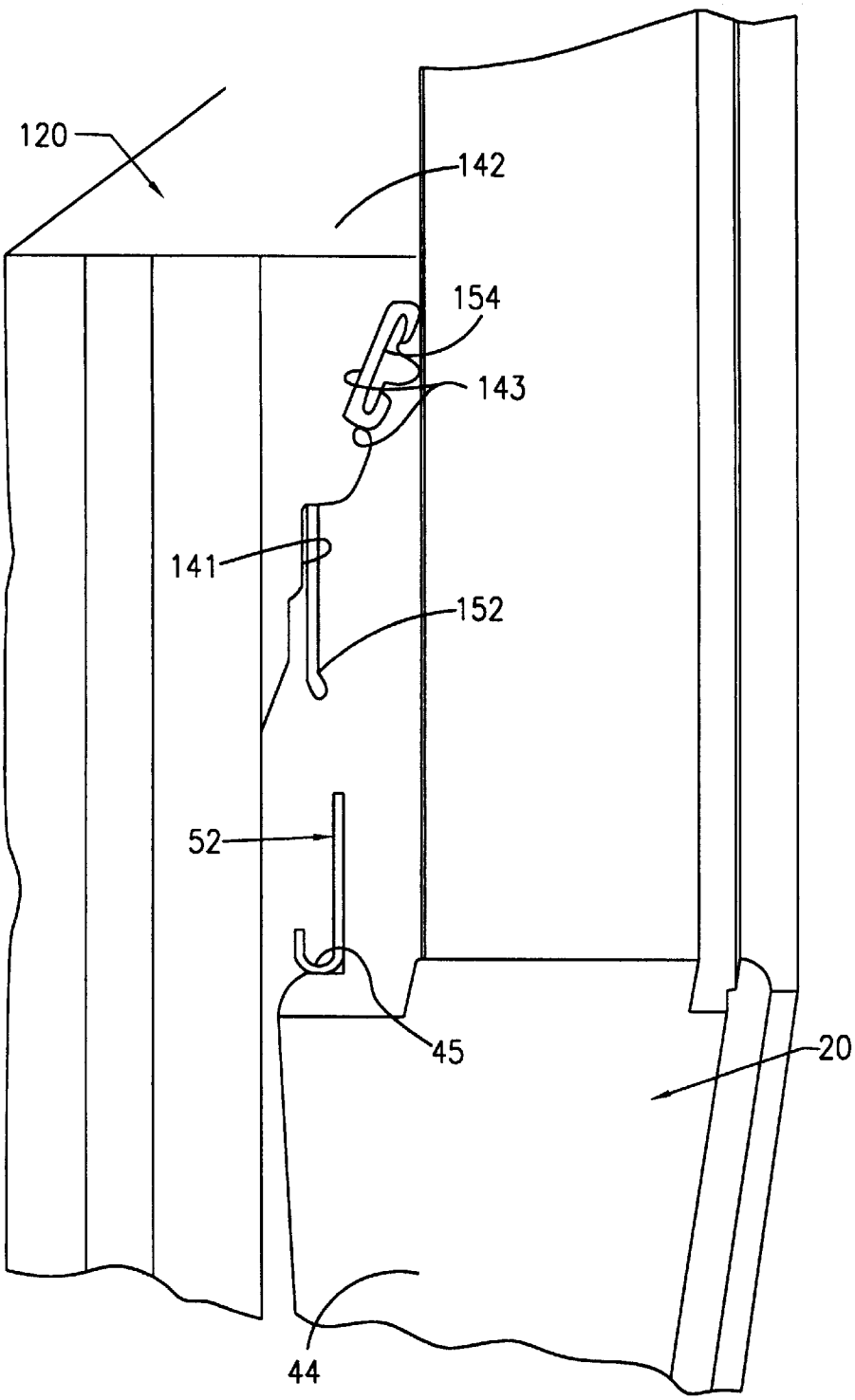
FIG. 5A is a side cross-sectional view of the double-hung window structure of the present invention taken along lines 5A—5A of FIG. 3A showing the weatherstripping arrangement within the upper and lower window members and frame member in an open position, respectively.
Figure 5B:
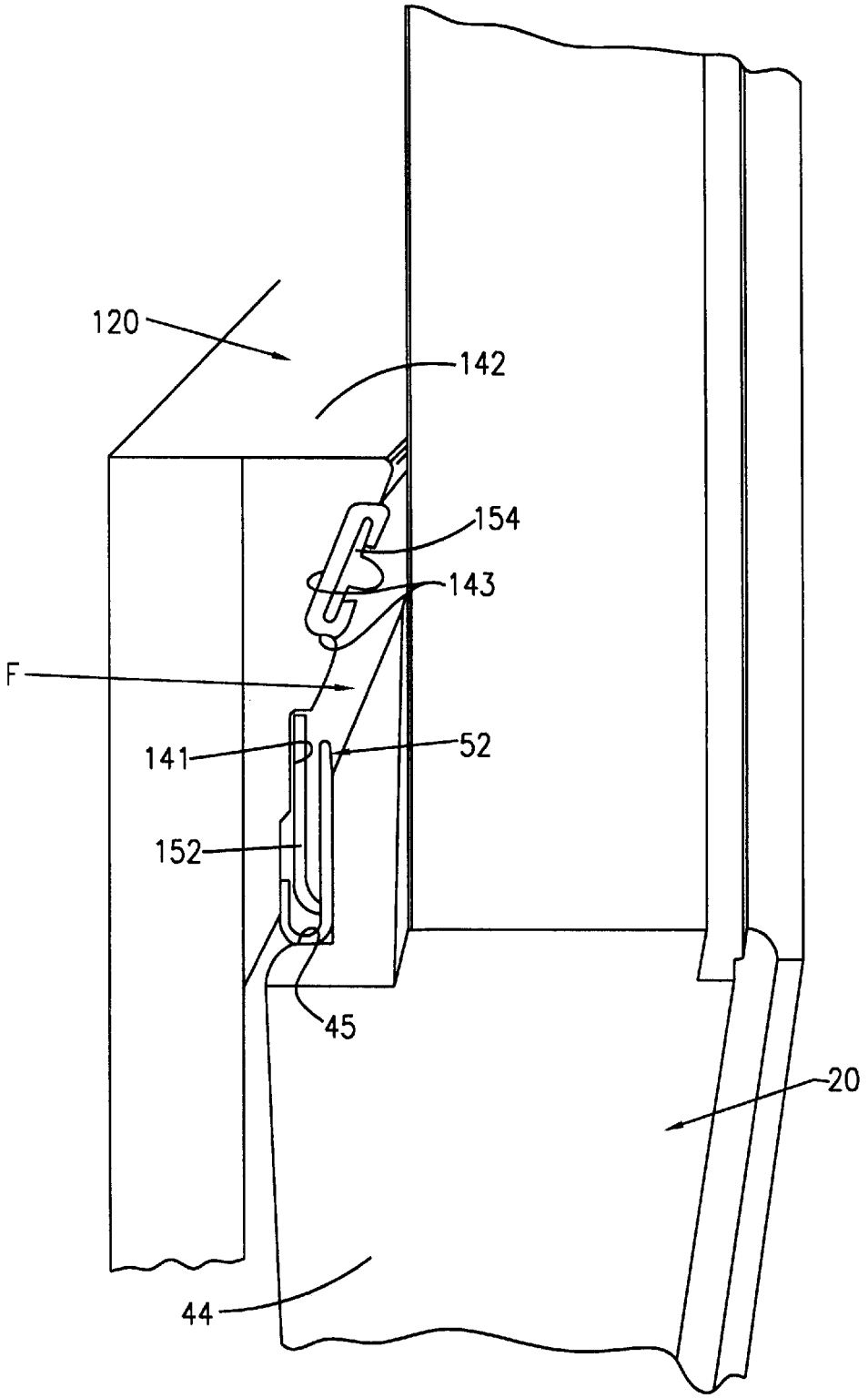
FIG. 5B is a side cross-sectional view of the double-hung window structure of the present invention taken along lines 5B—5B of FIG. 1 showing the weatherstripping arrangement within the upper and lower window members and frame member in a closed position, respectively.

The meeting rail 44 of upper window 20 in conjunction with the meeting rail 142 of lower window member 120, as shown in FIG. 5A, includes a plurality of rigid and flexible weatherstripping seals. These seals include an interlocking rigid metal weatherstripping seal 152, an interlocking J-shaped rigid metal weatherstripping seal 52, and a flexible Q-lon™ channel weatherstripping seal 154. The interlocking J-shaped rigid metal weatherstripping seal 52 is located on the meeting rail 44 of upper window member 20, as depicted in FIGS. 5A, 5B and 7 of the drawings. The interlocking rigid metal weatherstripping seal 152 and the flexible Q-lon™ channel weatherstripping seal 154 are located on the meeting rail 142 of lower window member 120, as shown in FIG. 5A of the drawings.

The sixth sealing assembly F is arranged in such a manner that the interlocking J-shaped rigid metal weatherstripping seal 52 is attached by a plurality of brads (not shown) to a lower ledge section 45 of meeting rail 44 on upper window 20. The interlocking rigid metal weatherstripping seal 152 is attached by a plurality of brads (not shown) to a lower ledge section 141 of the meeting rail 142 of lower window 120. Seal 152 slidably interconnects with the J-shaped seal 52, as shown in FIGS. 5A and 5B of the drawings. Additionally, the flexible Q-lon™ channel weatherstripping seal 154 is positioned above the interlocking rigid metal weatherstripping seal 152 on upper ledge section 143 of the meeting rail 142, as shown in FIG. 5A of the drawings. Seal 154 is attached by a plurality of staples (not shown) along the upper ledge section 143 of the meeting rail 142.

The bottom rail 144 of lower window 120 in conjunction with the lower window track 282 of sill 242 of window frame 200 includes a plurality of rigid and flexible weatherstripping seals. These seals include a sill rigid metal weatherstripping seal 156, and a pair of sill L-shaped flexible Q-lon™ weatherstripping seals 158 and 160, both being located within the bottom rail 144 of lower window 120. The sill flexible Q-lon™ channel weatherstripping seal 286 is located within the lower window track 284 of sill 242, as depicted in FIG. 7 of the drawings. The aforementioned rigid metal weatherstripping seals are made from metals such as zinc, brass, copper, stainless steel and the like.

Figure 6B:
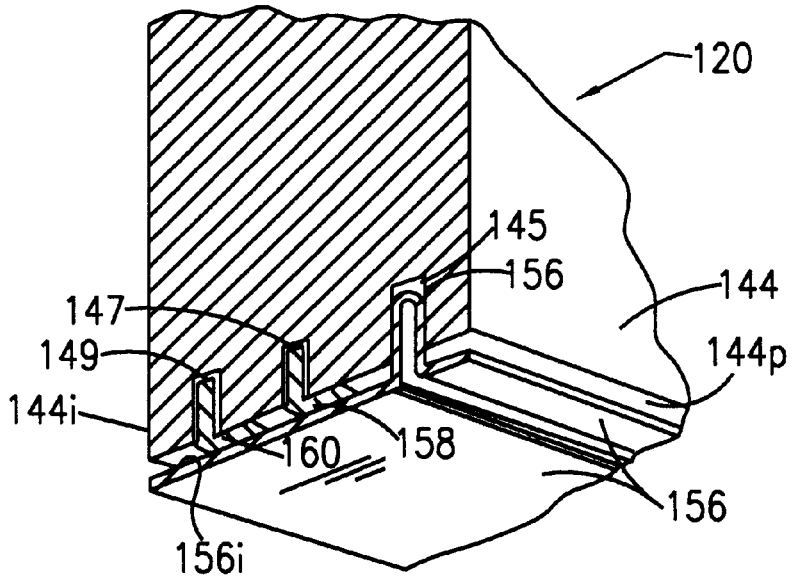

The seventh sealing assembly G is arranged in such a manner that the rigid metal weatherstripping seal 156 has an extending tongue member 156*t* which is received within a first sill receiving groove 145 of the bottom rail 144 of lower window 120. This rigid metal weatherstripping seal 156 is held in place by a plurality of brads (not shown) on the edge of the bottom rail 144. The L-shaped sill flexible Q-lon™ weatherstripping seals 158 and 160 are received within second and third transom grooves 147 and 149, respectively, of the bottom rail 144 of lower window 120, respectively, as depicted in FIG. 6B of the drawings. Seals 158 and 160 are adjacent to and in contact with the interior wall surface 156*i* of the rigid metal weatherstripping seal 156. Seals 158 and 160 are held in place within grooves 147 and 149, respectively, with silicon adhesives (not shown). Additionally, the sill 242 includes a grooved channel 244 for receiving therein the frame sill flexible Q-lon™ channel weatherstripping seal 286. Seal 286 is positioned on the sill 242, as shown in FIG. 7 of the drawings, such that the interior wall surface 144*i* of the sill 242 abuts and is adjacent to seal 286. Seal 286 is held in place by a plurality of staples (not shown) that are stapled to the seal 286 within the grooved channel 244.

Generically, a Q-lon™ channel weatherstripping seal is a channel compression weatherstripping seal clad in a plastic urethane foam; and a Q-lon™ weatherstripping seal is a compression weatherstripping seal. Q-lon™ weatherstripping seals are sold by Schlegel Systems Inc.

Figure 2:
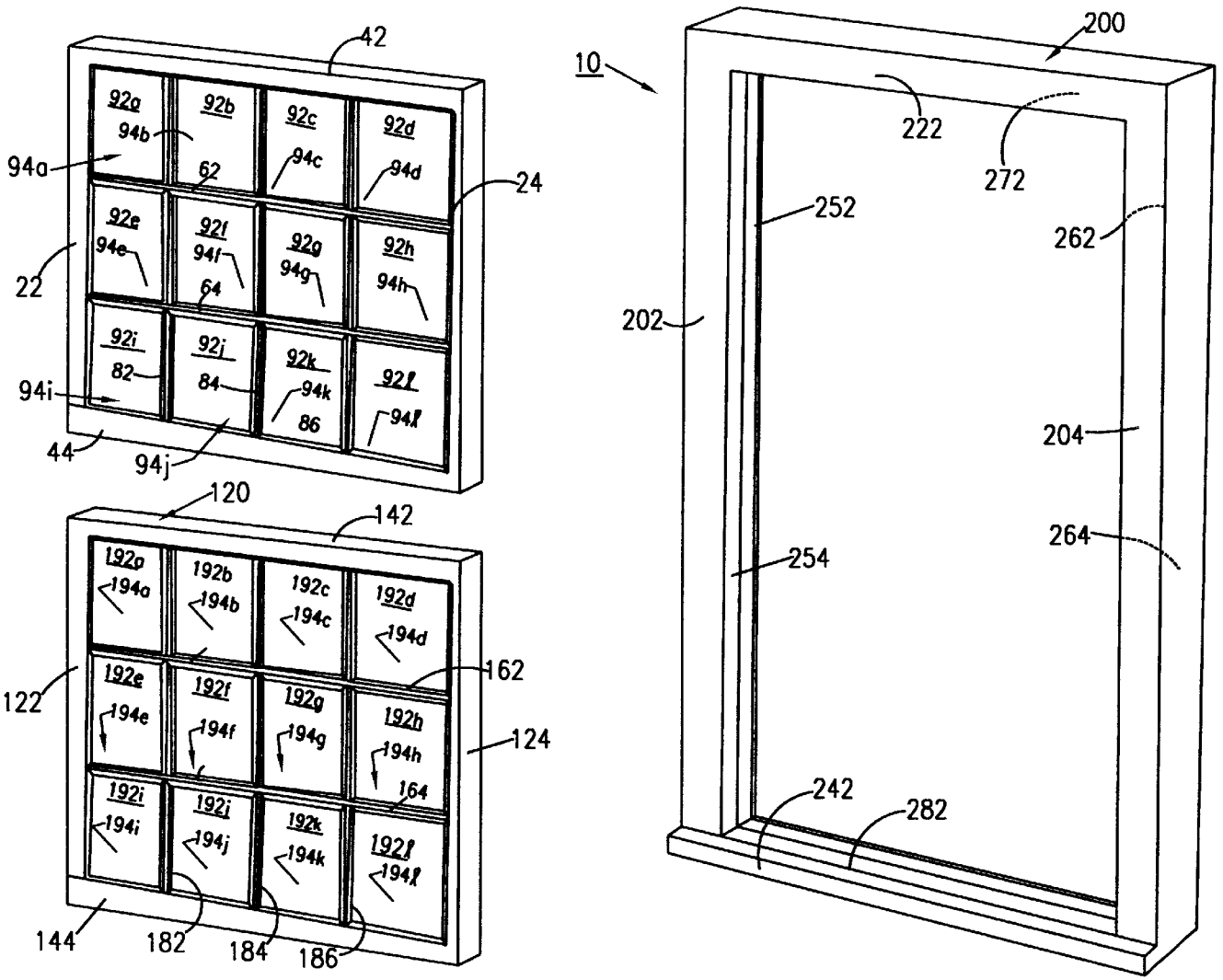
FIG. 2 is an exploded perspective view of the double-hung window structure of the present invention showing the upper and lower window members and the window frame in an unassembled configuration.
Figure 4:
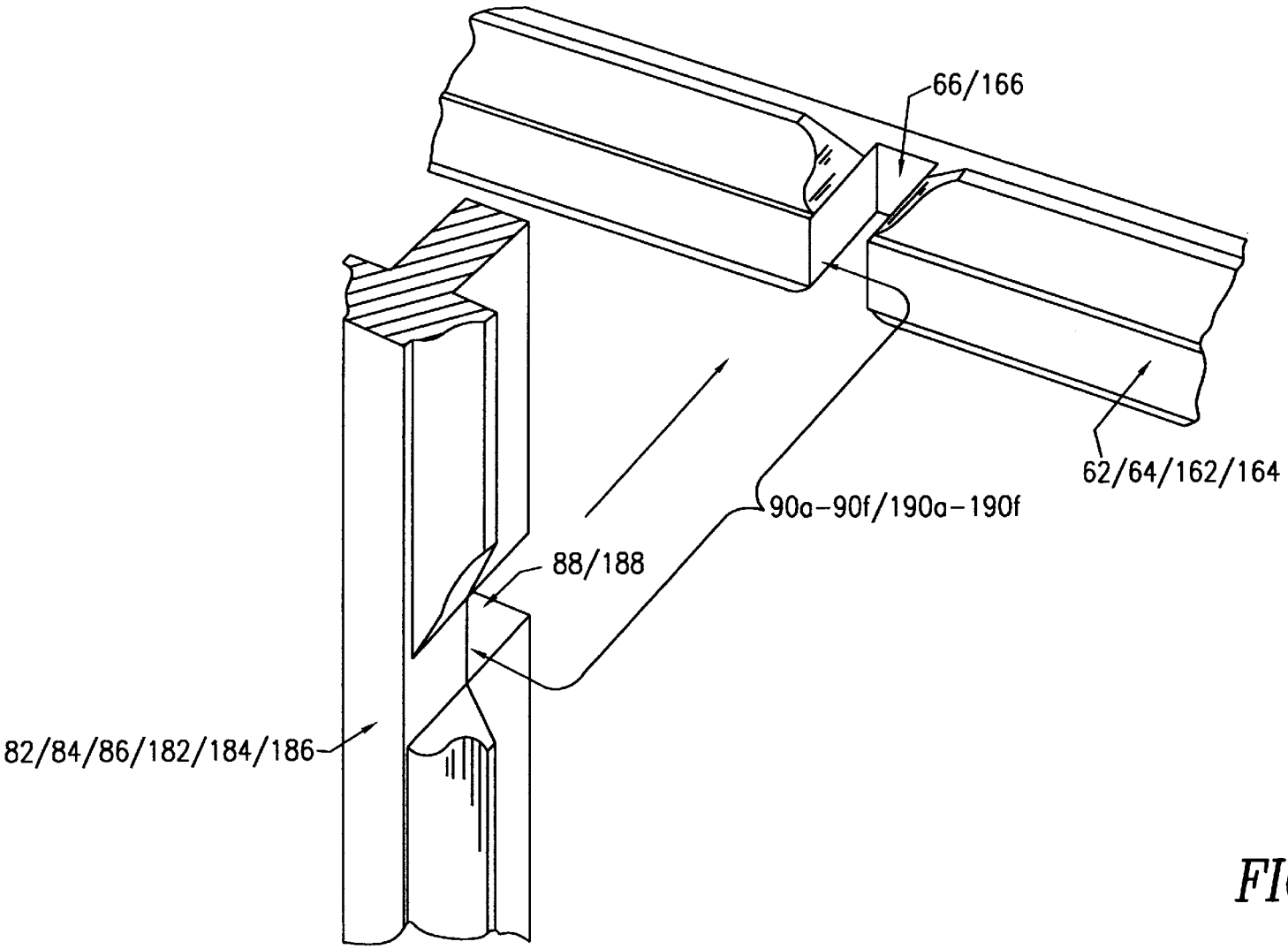
FIG. 4 is an exploded perspective view of the double-hung window structure of the present invention showing the joining of a U-shaped joint (half lap joint) on a mutton horizontal member to a U-shaped joint (half lap joint) on a mutton vertical member to form a mutton structural joint in forming of window openings of each window member.

Each of the mutton horizontal members 62 and 64 includes a plurality of equally-spaced apart half lap joints or coped joints which include first U-shaped joints 66 being saw-cut/routed therein. Each of the mutton vertical members 82, 84 and 86 includes a pair of equally-spaced apart half lap joints or coped joints which include second U-shaped joints 88 being saw-cut/routed therein. The horizontal and vertical mutton members 62, 64, 82, 84 and 86 are joined together, wherein the first and second U-shaped joints 66 and 88 are positioned and joined together at 90° degrees relative to each other and interlock to form a plurality of mutton structural joints 90*a* to 90*f*. Joints 66 and 88 are joined together to form mutton structural joints 90*a* to 90*f* on the mutton horizontal members 62 and 64 and on the mutton vertical members 82, 84 and 86, respectively, for the upper window member 20, as shown in FIGS. 1, 2 and 4 of the patent drawings.

Each of the mutton horizontal members 162 and 164 includes a plurality of equally-spaced apart half lap joints or coped joints which include third U-shaped joints 166 being saw-cut/routed therein. Each of the mutton vertical members 182, 184 and 186 includes a pair of equally-spaced apart half lap joints or coped joints which include fourth U-shaped joints 188 being saw-cut/routed therein. The horizontal and vertical mutton members 162, 164, 182, 184 and 186 are joined together, wherein the third and fourth U-shaped joints 166 and 188 are positioned and joined together at 90° degrees relative to each other and interlock to form a plurality of mutton structural joints 190*a* to 190*f*. Joints 166 and 188 are joined together to form mutton structural joints 190*a* to 190*f* on the mutton horizontal members 162 and 164 and on the mutton vertical members 182, 184 and 186, respectively, for the lower window member 120, as shown in FIGS. 1, 2 and 4 of the patent drawings.

These aforementioned joints 90*a* to 90*f* for upper window member 20, and joints 190*a* to 190*f* for lower window member 120 afford additional strength and structural integrity to the double-hung window structure 10 against failure, breakage, warping due to high winds and the like.

The horizontal and vertical mutton members 62, 64, 82, 84, 86, 162, 164, 182, 184 and 186 of the upper and lower window members 20 and 120, respectively, are made from hard woods having an oven dried density of at least 44.0 lbs/ft$^3$; an air dried modules of rupture (twisting/torque) of at least 11,000 psi; and an air dried modules of elasticity (flexing/bending) of at least 1,066,000 psi. The hard woods used for the horizontal and vertical mutton members 62, 64, 82, 84, 86, 162, 164, 182, 184 and 186 are selected from the group consisting of beeches, birches, ebony, eucalyptus, hickories, jacaranda (Brazilian rosewood), locusts, mahogany, oaks, persimmon, and satinwood.

The double-hung structure 10 based upon the SCA specifications has a design wind load performance of at least 40 psf; and a water test pressure performance of at least 6 psf. The SCA specifications are set forth in the N.W.W.D.A. I.S.

2-93, Industry Standard for Wood Window Units, Performance Grade DP-40.

Operation of the Present Invention

In operation, the double-hung window structure 10 of the preferred embodiment of the present invention, as shown in FIGS. 1 through 8, operates in the following manner in order to resist water intrusion/penetration and wind flexing of the window structure 10 when in the operational mode.

The first, second, third and fourth sealing assemblies A, B, C and D, respectively, as previously described are so arranged that water penetration is initially stopped on the outer portion of each of the flexible Q-lon™ channel weatherstripping seals 206 and 208, respectively. If water penetration passes seals 206 and/or 208, water can be then collected within the tongue depression 30 of tongue member 28 of each rigid metal weatherstripping seal 26, if necessary.

The fifth sealing assembly E as previously described is so arranged that water penetration is initially stopped on the outer portion of each flexible Q-lon™ channel weatherstripping seal 224 and/or 226. If water penetration passes seals 224 and/or 226 the water is additionally stopped by the pair of inverted L-shaped flexible Q-lon™ weatherstripping seals 48 and 50 on top rail 42 of upper window 20, respectively. Further, the water penetration can also be collected within the tongue depression **46*d* of tongue member 46*t* on the rigid metal weatherstripping seal 46**, if necessary.

The sixth sealing assembly F as previously described is so arranged that water penetration is initially stopped on the outer portion of the flexible Q-lon™ channel weatherstripping seal 154. If water penetration passes seal 154 the water is additionally stopped by the combined interlocking rigid metal weatherstripping seals 52 and 152 of upper and lower windows 20 and 120, respectively.

The seventh sealing assembly G as previously described is so arranged that water penetration is initially stopped on the outer portion of the flexible Q-lon™ channel weatherstripping seal 286. If water penetration passes seal 286 the water is additionally stopped by an L-shaped flexible Q-lon™ weatherstripping seal 158 on bottom rail 144 of lower window 120. Further, the water penetration can also be collected within the tongue depression 164 of tongue member 162 on the rigid metal weatherstripping seal 156, if necessary.

The plurality of mutton structural joints **90*a* to 90*f* and 190*a* to 190*f* for the upper and lower windows 20 and 120, respectively gives the double-hung window structure 10 additional structural strength not normally associated with window closures in conventional double-hung windows. These mutton structural joints 90*a* to 90*f* and 190*a* to 190*f*** are able to withstand a wind load performance of at least 40 psf.

Advantages of the Present Invention

Accordingly, an advantage of the present invention is that it provides for an improved double-hung window structure for school buildings that meets all the safety standards and specifications set by the SCA (for school buildings) with regard to water leakage, wind resistance, structural flex and the like.

Another advantage of the present invention is that it provides for a double-hung window structure that includes improved weatherstripping arrangements for preventing water leakage through the window during inclement weather, such as snow, rain, hail, ice and/or wind.

Another advantage of the present invention is that it provides for a double-hung window structure that includes improved strength and structural characteristics in order to resist and/or flex during inclement weather during which high winds occur, such as in northeastern storms, hurricanes, tornadoes, typhoons, tropical storms, and the like.

Another advantage of the present invention is that it provides for a double-hung window structure that improves and maximizes the weather protection and energy efficiency of these window closures for providing improved window durability, and improved school building performances (with regard to heat, electricity, air conditioning) and economy.

A further advantage of the present invention is that it provides for a double-hung window structure that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A double-hung window structure comprising:

a) an upper window and a lower window within a window frame; said upper window having left and right side stiles, a top rail, and a meeting rail for forming said upper window;

b) said upper window having therein a plurality of horizontal and vertical mutton members for forming a plurality of window openings with each having a window pane therein; said horizontal and vertical mutton members being interlocked by half-lap joints;

c) said lower window having left and right side stiles, a meeting rail, and a bottom rail for forming said lower window;

d) said lower window having therein a plurality of horizontal and vertical mutton members for forming a plurality of window openings with each having a window pane therein; said horizontal and vertical mutton members being interlocked by half-lap joints;

e) said window frame having left and right frame jambs, an upper header, and a sill for forming said window frame; said frame jambs having upper and lower vertical window frame tracks, respectively, therein; said upper header having an upper horizontal window track therein; and said sill having a lower horizontal window track therein;

f) first sealing means located between said right stile of said upper window and said right jamb of said window frame and includes a first rigid metal weatherstripping seal and a first pair of flexible channel compression weatherstripping seals clad in a plastic urethane foam; second sealing means located between said left stile of said upper window and said left jamb of said window frame and includes a second rigid metal weatherstripping seal and a second pair of flexible channel compression weatherstripping seals clad in a plastic urethane foam; third sealing means located between said right stile of said lower window and said right jamb of said window frame and includes a third rigid metal weatherstripping seal and a third pair of flexible channel compression weatherstripping seals clad in a plastic urethane foam; and fourth sealing means located between said left stile of said lower window and said left jamb of said window frame and includes a fourth rigid metal weatherstripping seal and a fourth pair of flexible channel compression weatherstripping seals clad in a plastic urethane foam;

g) fifth sealing means located between said top rail of said upper window and said upper window track of said upper header of said window frame;

h) sixth sealing means located between said meeting rail of said upper window and said meeting rail of said lower window;

i) seventh sealing means located between said bottom rail of said lower window and said lower window track of said sill of said window frame.

2. A double-hung window structure in accordance with claim 1, wherein said fifth sealing means located between said top rail of said upper window and said upper window track of said upper header of said window frame includes a fifth rigid metal weatherstripping seal, a fifth pair of flexible compression weatherstripping seals, and a pair of flexible channel compression weatherstripping seals clad in a plastic urethane foam which seals and interlocks said top rail of said upper window and said upper window track of said upper header of said window frame from inclement weather.

3. A double-hung window structure in accordance with claim 1, wherein said sixth sealing means located between said meeting rail of said upper window and said meeting rail of said lower window includes an interlocking sixth rigid metal weatherstripping seal, an interlocking J-shaped rigid metal weatherstripping seal, and a flexible channel compression weatherstripping seal clad in a plastic urethane foam which seals and interlocks said meeting rail of said upper window and said meeting rail of said lower window from inclement weather.

4. A double-hung window structure in accordance with claim 1, wherein said seventh sealing means located between said bottom rail of said lower window and said lower window track of said sill of said window frame includes a seventh rigid metal weatherstripping seal, a pair of flexible compression weatherstripping seals, and a flexible channel compression weatherstripping seal clad in a plastic urethane foam which seals and interlocks said bottom rail of said lower window and said lower window track of said sill of said window frame from inclement weather.

5. A double-hung window structure in accordance with claim 1, wherein said rigid metal weatherstripping seal is made from metals selected from the group consisting of zinc, brass, copper and stainless steel.

6. A double-hung window structure in accordance with claim 1, wherein said mutton members are made from woods selected from the group consisting of beeches, birches, ebony, eucalyptus, hickories, jacaranda (Brazilian rosewood), locusts, mahogany, oaks, persimmon, and satinwood.

7. A double-hung window structure in accordance with claim 1, wherein said mutton members are made from woods having a module of rupture of at least 11,000 psi.

8. A double-hung window structure in accordance with claim 1, wherein said mutton members are made from woods having a module of elasticity of at least 1,066,000 psi.

9. A double-hung window structure in accordance with claim 1, wherein said window structure has a design wind load performance of at least 40 psf.

10. A double-hung window structure in accordance with claim 1, wherein said window structure has a water test pressure performance of at least 6 psf.

11. A double-hung window structure in accordance with claim 1, wherein said plurality of interlocking horizontal and vertical mutton members include a plurality of first and second U-shaped interlocking half-lap joints, wherein said first and second U-shaped interlocking half-lap joints are positioned and joined together at 90° degree angles relative to each other and interlock to form a plurality of mutton structural joints.

* * * * *